US010556740B2

(12) United States Patent
Bonner et al.

(10) Patent No.: US 10,556,740 B2
(45) Date of Patent: Feb. 11, 2020

(54) SYSTEM OF PERSONAL CARE PRODUCTS FOR HUMAN DEVELOPMENTAL STAGES

(71) Applicant: Johnson & Johnson Consumer Inc., Skillman, NJ (US)

(72) Inventors: Patricia Bonner, Branchburg, NJ (US); Janeta Nikolovski, Princeton, NJ (US); Hanan Wajih, Skillman, NJ (US); Sandrine Alvarado, Belle Mead, NJ (US); Helene Zunino, Saint Cyr l'Ecole (FR); Maria Urista Cardenas, West Windsor, NJ (US)

(73) Assignee: Johnson & Johnson Consumer Inc., Skillman, NJ (US)

( * ) Notice: Subject to any disclaimer, the term of this patent is extended or adjusted under 35 U.S.C. 154(b) by 151 days.

(21) Appl. No.: 15/585,388

(22) Filed: May 3, 2017

(65) Prior Publication Data

US 2018/0009600 A1 Jan. 11, 2018

Related U.S. Application Data

(60) Provisional application No. 62/358,213, filed on Jul. 5, 2016.

(51) Int. Cl.
*B65D 85/00* (2006.01)

(52) U.S. Cl.
CPC ..... *B65D 85/70* (2013.01)

(58) Field of Classification Search
CPC ... B65D 85/70; A45D 34/00; A45D 2034/007
USPC ..... 206/459.5, 459.1
See application file for complete search history.

(56) References Cited

U.S. PATENT DOCUMENTS 5,242,057 A * 9/1993 Cook ..... A47K 10/421 206/233
7,098,180 B2 8/2006 Ganopolsky et al.
7,866,507 B2 * 1/2011 Sawin ..... B65D 25/205 206/216
8,342,333 B2 * 1/2013 Snell ..... A61F 13/15747 206/581
8,435,222 B2 * 5/2013 Ronn ..... A61F 13/84 604/385.02
2002/0072723 A1 * 6/2002 Ronn ..... A61F 13/84 604/358
2005/0065492 A1 * 3/2005 Cole ..... A61F 13/15577 604/385.01
2005/0279579 A1 * 12/2005 Milk ..... A47F 7/28 186/52
2006/0193898 A1 8/2006 Norman
2007/0095705 A1 * 5/2007 Legault ..... B65D 75/00 206/459.5
2007/0251851 A1 * 11/2007 Warren ..... A61F 13/84 206/494
2008/0128308 A1 * 6/2008 Betts ..... A47F 3/00 206/440
2008/0230424 A1 * 9/2008 Chawla ..... B65D 1/0223 206/459.5
2010/0181223 A1 * 7/2010 Warren ..... A61F 13/84 206/494
2011/0215017 A1 9/2011 Coulter et al.
2013/0056380 A1 * 3/2013 Craig ..... A61K 8/38 206/459.5
2016/0038353 A1 * 2/2016 Bonilla ..... A61F 13/5514 604/385.02

FOREIGN PATENT DOCUMENTS

EP 1891919 A 2/2008
WO WO 2007/092484 A 8/2007
WO WO 2013/009732 A 1/2013
WO WO 2015/191070 A 12/2015

OTHER PUBLICATIONS

International search report and written opinion dated Jul. 20, 2017, for PCT/US2017/030806.

* cited by examiner

*Primary Examiner* — Chun Hoi Cheung
(74) *Attorney, Agent, or Firm* — Laura A. Donnelly

(57) ABSTRACT

A system of personal care products including a first personal care product for a human at stage 1 of its life, the first personal care product including a package attribute and a formulation attribute designed for the human at stage 1 of life; a second personal care product for a baby at stage 2 of its life, the second personal care product including a package attribute and a formulation attribute designed for the human at stage 2 of life; and a third personal care product for a baby at stage 3 of its life, the third personal care product including a package attribute and a formulation attribute designed for the human at stage 3 of life.

17 Claims, No Drawings

SYSTEM OF PERSONAL CARE PRODUCTS FOR HUMAN DEVELOPMENTAL STAGES

This application claims the benefit of U.S. provisional application 62/358,213 filed on Jul. 5, 2016, the complete disclosure of which is hereby incorporated herein by reference for all purposes.

FIELD

The invention relates to systems, methods, displays and kits for personal care products for particular ages and/or stages of human development.

BACKGROUND

Personal care products are used for a variety of health and hygiene reasons, including, for example, cleansing and skin moisturizing. Different products, however, may not all be appropriate for a particular age or stage of human development. For example, younger humans, including babies, often require a milder and gentler product, while adult skin may be more able to handle a harsher and less mild cleanser.

In addition to the hygiene-related benefits of product usage, there are cognitive and developmental milestones that are achieved at different stages of human life, beginning at day one and changing throughout the aging process. While some products are geared towards age appropriate milestones, such as toys and educational devices, personal care products typically are not.

The present invention relates to a system of products that are designed for, and account for, the developmental needs of particular ages and stages of life, while also accounting for the health and hygiene needs associated with such stages. Heretofore, such systems and packages have not accounted for the developmental (including emotional, cognitive and social) and physical health milestones concurrently across a plurality of stages of life.

SUMMARY

A system of personal care products including a first personal care product for a human at stage 1 of its life, the first personal care product including a package that includes a simple color and one simple shape, the first personal care product having a high mildness score, being free of dye, and having a formulation attribute designed for the first stage of life; a second personal care product for a baby at stage 2 of its life, the second personal care product including a package that includes more colors than the first personal care product, and the package having at least two different simple shapes, the second personal care product having a formulation attribute designed for the second stage of life, and which is different than the first personal care product during use; and a third personal care product for a baby at stage 3 of its life, the third personal care product including a package that includes more colors than the second personal care product, the third package including complex shapes, the third personal care product a formulation attribute designed for the third stage of life, and which is different than the second personal care product during use. The products may each include a distinct Stage Indicator identifying the intended stage of use of the product.

In another embodiment, there is a system of personal care products for a selected stage of life including a first personal care product for a human at stage 1 of its life, the first personal care product including a package that includes a simple color and one simple shape, the first personal care product including a stage indicator identifying stage 1 of life, the first personal care product having a formulation attribute designed for the human at stage 1 of life; a second personal care product for a human at stage 1 of its life, the second personal care product including a package that includes a simple color and one simple shape, the second personal care product including a stage indicator identifying stage 1 of life, the second personal care product having a formulation attribute designed for the human at stage 1 of life; and a third personal care product for a human at stage 1 of its life, the third personal care product including a package that includes a simple color and one simple shape, the third personal care product including a stage indicator identifying stage 1 of life, the third personal care product having a formulation attribute designed for the human at stage 1 of life; where the stage indicator identifying stage 1 of life is the same for each of the first personal care product, the second personal care product, and the third personal care product. The products may each include a different Use Indicator identifying the intended use of each product.

Methods of using, displaying, or selling the system are also included in this application. In some aspects, the display may include a Stage Display to aid in identifying for consumers the appropriate system to choose from, or combination of attributes and Indicia that are relevant to the appropriate consumer given the particular Stage of life they are selecting product(s) for.

DETAILED DESCRIPTION

The present invention relates to systems, methods, packages and kits for providing a product or plurality of products to humans, where the products are appropriately packaged and formulated for a particular stage of human life. Specifically, the products include personal care products and packages for these personal care products. As used herein, "personal care products" include those products intended for health and/or hygiene, including, for example, cleansers for skin and hair, including washes, shampoos, conditioning agents for skin and hair, and bar cleansers; moisturizing products, including lotions, oils and creams; powders; pain relieving products; wipes; cleansing water; liquid powders; oil to powder formulations; butters; solid oil; ointments; gels; and fragrance enhancing products, such as colognes and perfumes. The term "products", as used and described herein, shall refer to personal care products unless otherwise stated.

Personal care products may typically be formulated to be suitable for the age of a human's life, including product features such as mildness and low skin or eye irritation for newborn babies whose skin needs differ from those of an adult, however, products have not typically been provided in such a manner that takes into account the cognitive, emotional, social, and physical development of a human over the first several years of life. The present invention provides a system of products that include not only the product formulation within the package, but also the package in which the formulation is provided. Further, the present invention not only provides a product for one stage of life, but seeks to provide a range of products that take into account not only physical benefits desired and needed for a particular age or stage of life, but also the needs associated with various cognitive, emotional, and/or social stages of life.

The personal care products of the present invention are intended for at least three stages of life, which are collectively referred to as the Stages. Each "Stage", as used herein, defines a period of time in which a human has reached or is in the process of reaching at least one certain developmental milestone in cognitive, emotional, social and/or physical development. The specific developments associated with various Stages will be described in greater detail below. Through the present invention, reference is made to three Stages, ranging from a newborn baby until approximately 3 years of life, however, it is noted that these products may be used for and used by any person at any stage of life, if desired.

The present invention includes products, systems and methods related to the first three Stages of human life, which are respectively referred to as Stage 1, Stage 2 and Stage 3 of human life. As used herein, Stage 1 of a human life ranges approximately from birth to approximately six months of life. As used herein, Stage 2 of a human life ranges approximately from approximately six months of life to approximately 18 months of life. As used herein, Stage 3 of a human life ranges approximately from approximately 18 months and beyond. Of course, each child grows and develops at its own independent rate, and the ages referenced above may vary depending upon the particular child. These ages are exemplary of the typical growth and development of a human child over the three Stages, but the particular developmental milestones associated with each Stage are provided below. It may be appropriate that a 8 month old baby use Stage 1 products, for example, depending upon the developmental milestones that the baby has achieved. Further, there may optionally be a fourth Stage for older individuals to use, such as children above 3 years, or above 5 years, or for above 7 years.

The present inventors have discovered that, at each Stage of life, the human child currently has a specific set of needs (physical, cognitive, emotional, and social), and has achieved a specific set of developmental milestones. In addition, the human child experiences different things at each Stage of life, and the products and systems described herein track and embody those experiences. Experiences may include, for example, dietary needs and exposure to different foods and fragrances. Developmental needs include emotional, cognitive, social and physical needs. Each Stage is identified with a different set of these milestones and needs, and the present invention provides packages, products, systems and methods that are geared to and take into account each of the needs and milestones associated with these Stages.

Again, it is noted that the present invention does not simply provide a product or set of products that are formulated for specific physical needs only; rather, the invention provides products that are packaged, arranged, and formulated to account for a plurality of developmental needs of the human. By way of example, one product of the present invention may provide a body wash that is intended for Stage 1 of the human, where the body wash includes packaging attributes and formulation attributes that meet not only the physical, but also at least one of the cognitive, emotional and/or social needs of the Stage 1 human. The invention may also include a separate body wash that meets at least one physical and at least one other need of a Stage 2 human, and a separate body wash that meets at least one physical and at least one other need of a Stage 3 human.

As set forth above, the present invention relates to three Stages of human life. Stage 1 of human life is the first Stage, and the human in this Stage of life is referred to as a "baby". In Stage 1 ("baby") of human life, for example, the baby has a low cognitive ability, and is in the process of bonding with its caregiver (including, for example, a parent or other guardian). Stage 1 babies' skin is beginning to be able to thermoregulate and its skin pH equilibrates (from 7 to 5.5). The Stage 1 baby begins to be able to control its head and, towards the latter portion of Stage 1, is beginning to roll over. The Stage 1 baby begins to respond to sound and follow movement with its eyes, and begins to realize distance. Stage 1 babies eat mostly milk and/or formula, which are less messy than foods eaten at Stages 2 and 3. Emotionally, Stage 1 babies typically stop crying when picked up or held, and begin to bond with caregivers.

Stage 2 of human life is the next Stage that follows Stage 1, and the human in this stage of life is referred to as an "active baby". Stage 2 (the "active baby") of human life sees more cognitive development and changing body attributes than Stage 1. In Stage 2, the active baby is more attached to the caregiver and desirably has bonded with the caregiver. Emotionally, Stage 2 active babies begin to form attachments to caregivers and/or toys, as well as cry when left alone. The Stage 2 active baby is capable of crawling, sitting up, and towards the end of Stage 2, it may begin to stand up and explore its surroundings. The Stage 2 active baby plays with objects and with other humans, and imitates human behavior to a greater extent than the Stage 1 baby. Stage 2 active babies establish a slightly more reliable blink reflex, and its skin has regulated to a pH of approximately 5.5. Stage 2 active babies may have more hair on their head than a Stage 1 baby. Stage 2 active babies begin to transfer objects between hands and use objects correctly. Stage 2 active babies are able to begin exploring their environment and engage objects. Stage 2 active babies begin to eat more solid foods and are less reliant on milk and/or formula, and begin engaging with external objects, through crawling, sitting, and touching. Stage 2 active babies begin to react to music and other sounds, for example, bouncing when music is played. At later stages of Stage 2, the active baby begins to speak words and may act shy around strangers.

Stage 3 of human life is the next Stage that follows Stage 2, and the human in this stage of life is referred to as a "toddler". This third Stage (a "toddler") of human life sees the baby engaging in more independent behaviors and playing. The Stage 3 toddler may play independently or play with other humans, and is less reliant on the caregiver than in the earlier Stages. Stage 3 toddlers typically are capable of walking independently and eating foods with their own hands and with the use of tools such as utensils. Stage 3 toddlers have a more controlled and reliable blink reflex, better protecting the toddler's eyes from external materials. The Stage 3 toddler has increasing verbal communication and begins to show empathy towards other humans. The skin of the Stage 3 toddler is less sensitive than the skin at Stages 1 or 2, and has a tendency to get dirtier as the Stage 3 toddler engages in more active play and begins to eat foods independently. Stage 3 toddlers tend to have more hair on their heads than Stage 1 or Stage 2 babies, and the hair on a Stage 3 toddler may have different physical characteristics (e.g., it may be thicker, curlier, or longer) than Stage 1 or Stage 2 babies. In addition, Stage 3 toddler may have different personal cleansing needs as their bodies begin to sweat more than earlier stages.

It is understood that Stages 1, 2, and 3 above do not necessarily apply to each and every human at the precise ages identified for each stage, and each developmental milestone and need may not apply with precision as described above. A product designed for a Stage 2 active baby may be more effective with a Stage 3 toddler, for example, depending upon the particular development and growth of the human to which the product is used. Or alternatively, for example, a product designed for a stage 3 toddler may be suitable for use with a stage 2 active baby. The particular caregiver may better understand the cognitive and emotional development and needs of the child on which the product is to be used, and can determine which Stage product is appropriate. It is desirable that each product described herein be suitably mild to the skin and/or eyes of the person to whom the product is applied, as described in greater detail below.

Packaging Attributes

The invention includes at least one element or feature on or as part of the product packaging that is specific to each Stage, as defined above. As used herein, elements on or part of the package of a particular product are referred to herein as "packaging attributes", and may include, for example, graphics or logos on a product package, colors on the product package or as part of the package itself, the shape or configuration of the product, product dispensing means, and any other visual or textural features that are on or are a part of the package housing a product. The present inventors have discovered that particular packaging attributes and elements that form part of the package may be useful in aiding in human development and cognitive and emotional growth, while also allowing the caregiver to properly determine which product to use with his or her baby.

A first set of products are packaged in a set of packages designed for a Stage 1 baby. Stage 1 babies have low cognitive development, and in many instances are not capable of distinguishing color, complicated shapes, and/or a plurality of simple shapes. Stage 1 products are packaged in fairly simple packaging, with packaging attributes that are the most simple as compared to the Stage 2 or Stage 3 products. Stage 1 products may, for example, have a bottle or label that is one color, or includes various shades of one color (not including writing on the package, which may be its own color). The Stage 1 package may be duotone, or may include a color selected from a muted pastel color palette. In some aspects, the shapes and/or colors described herein are located in one section of the label, such as the top half of the label.

The package for a Stage 1 product may include one simple shape on its label, or the label may include a plurality of one simple shape. Simple shapes include, for example, squares, rectangles, triangles, circles, stars, hearts, crescents, and the like. In addition to packaging attributes described herein, the Stage 1 product may include one or more indicia that identify the intended use and/or the intended Stage, as will be described in greater detail below. Stage 1 packaging is intended to allow the caregiver to understand the contents of the package, its use, its intended Stage, where the understanding can be achieved quickly without distracting features on the label.

A second set of products are packaged in a set of packages designed for a Stage 2 active baby. Active babies have reached a higher level of cognitive development than Stage 1 babies (although less than a Stage 3 toddler). Stage 2 active babies are typically more capable of determining color and distinguishing a plurality of different simple shapes than a Stage 1 baby. Further, as used herein, a package designed for active babies may desirably encourage discovery by the Stage 2 active baby and allow the caregiver to teach and engage the developing visual senses of the Stage 2 active baby. Stage 2 packaging includes visual packaging attributes that stimulate the Stage 2 active baby's senses and allow the active baby to experience and interact with the package. In addition, packaging for the Stage 2 active baby may enable and encourage use by the active baby and caregiver concurrently during use.

Stage 2 products may include, for example, more than one color, such as two contrasting shades of colors (not including the writing on the package, which may be its own color). The Stage 2 products may incorporate a wider, more vibrant color palette than the Stage 1 products. The package may include at least two different simple shapes on its label, or may include a plurality of at least two simple shapes on its label. Simple shapes include, for example, squares, stars, rectangles, triangles, circles, stars, hearts, crescents, and the like. In addition to packaging attributes described herein, the Stage 2 product may include indicia that identify the intended use and/or the intended Stage, as will be described below. Stage 2 packaging is intended to allow the caregiver to understand the contents of the package, its use, its intended Stage, and includes design features that will engage the Stage 2 active baby's senses to a greater extent than a Stage 1 baby.

A third set of products are packaged in packages designed for a Stage 3 toddler. Stage 3 toddlers have reached greater cognitive, emotional, social, and physical development levels than a Stage 2 active baby, and are capable to independently handle and experience a package with curiosity and imagination. Stage 3 packages are intended to encourage the toddler to independently use the package, and to maximize the senses of the toddler. The package therefore desirably has packaging attributes on it that are stimulating and excite the toddler. In some aspects, the Stage 3 package may be physically used by the toddler without assistance from the caregiver, including by opening the package and/or dispensing product from the package.

The third set of products may include a plurality of colors in bright and contrasting shades. The package may include more complicated shapes or designs that are not merely "simple shapes", as defined above, although simple shapes may be found on the package. Stage 3 packages may include shapes that are more complicated than simple shapes, including, for example, depictions of things that appear in nature, such as clouds, sun, trees, houses, or may include logos, animals, cartoons, nature scenes, and the like. In one aspect, Stage 3 products may include packaging attributes that engage the toddler's cognitive function, such as by incorporating one or more simple shapes in the design, such as by being hidden in the design element, allowing the toddler to locate and discover a simple shape in the larger design.

The Stage 3 packages may also have features that change color in response to certain stimuli, such as heat or wetness, or may include lenticular elements that create the appearance of movement when the product is handled by the toddler. Stage 3 products may include packaging attributes that have a three dimensional feel to them, adding depth to the scene. Stage 3 products may also include different product forms that may be used by the developed Stage 3 toddler, but cannot be used by a stage 1 baby or a stage 2 active baby. For example, Stage 3 cleansing products may include a bar soap or other hand-held washing tool, which takes into account the cognitive development of a Stage 3 toddler. In one embodiment, the Stage 3 products may be in the shape of an animal or toy or other non-conventional bottle shape. Stage 3 products may have a dispenser that differs from that of a Stage 1 or Stage 2 product, where the toddler may actuate the dispenser independently and retrieve the personal care product housed therein.

In addition to packaging attributes described herein, the Stage 3 product may also include indicia that identify the intended use and/or the intended Stage, as will be described below. Stage 3 packaging is intended to allow the caregiver and/or the toddler itself to understand the contents of the package, its use, its intended Stage, and includes design features that are active and encourage the Stage 3 toddler to independently play with and manipulate the package during use.

With respect to each other, the packaging attributes on a Stage 1 product are the simplest, and the packaging attributes on a Stage 3 product are the most complicated, with the packaging attributes on Stage 2 being more simple than Stage 1 but less complicated than Stage 3. Further, the Stage 1 products use less varying colors, Stage 3 products use the most varying colors, and Stage 2 products use color schemes that are more varying than Stage 1 but less varying than Stage 3.

Thus, for a set of products (e.g., a wash, a shampoo, a lotion, and the like), the Stage 1 product should differ in at least one packaging attribute from the Stage 2 product, and the Stage 2 product should differ in at least one packaging attribute from the Stage 3 product, and the Stage 3 product should differ in at least one packaging attribute from the Stage 1 product. The packaging attribute differences among the products are desirably based on a specific developmental need of the human at that stage of life.

Product Formulation Attributes

As noted above, the invention relates to packages, systems, and products that meet various needs of the human at particular stages of life. In addition to the package attributes, described above, the product formulations may also have specific attributes that meet the various needs of the human at the intended Stage of life. Desirably, each product of the present invention is a personal care product, where the actual formulation to be used is intended for and meets the physical needs of a human at a specific stage of life. In addition, as explained previously, it is desired that the product be packaged in a way that meets at least one additional need of the human at the stage of life (such as emotional, cognitive or social needs).

In this way, the present invention is useful for the personal care associated with the product and meets physical needs of the human during use, but the present invention concurrently also meets other needs beyond physical needs of the human.

As used herein, the term "product formulation attribute" or "formulation attribute" refers to at least one characteristic of the personal care product. Product formulation attributes are related to the composition to be used, and not the package in which the formulation is housed. For a lotion, for example, product formulation attributes may relate to the chemical composition of the lotion, or physical characteristics of the lotion. For a wipe product, for example, the product formulation attributes may relate to the wipe fabric or the chemical composition embedded within the wipe. Product formulation attributes are distinct from package attributes, and desirably a final product includes both a product formulation attribute as described herein, as well as a separate package attribute described herein.

Product formulation attributes include, by way of example, at least one of the absence or presence of dyes or other pigments, the foaming profile of the product during use, the bubble forming ability during use, the presence or absence of fragrances, and the type of fragrance used, the thickness of the product, the mildness of the product to the skin and/or the eyes, the cushion profile of the product when dispensed, the rinsability of the product during use, the formation of a residue after application, the texture of the product and whether it provides a non-slip grip or low-slip grip during use, the ability of the product to form a barrier on the skin of the human after use, the imparting of softness on the skin of the human during and after the use, and providing a cooling or warming sensation on the skin. As noted above, a formulation attribute is not necessarily limited to the inclusion of a particular component or feature, but may include the absence or lack of a particular component or feature.

Product formulation attributes are desirably associated with each stage of life, as those Stages are defined above. A Stage 1 baby, as described above, has developing and changing skin, where the skin and eyes of the baby are quite sensitive. In addition, the Stage 1 baby has low cognitive and social abilities, and therefore the product formulation may reflect the needs at this stage of life. Stage 1 products may include certain formulation attributes, which include, for example, the lack of added dyes or pigments.

Stage 1 cleansing products should have product formulation attributes such as a high mildness profile, so as to be mild to the skin and eyes, particularly given that the Stage 1 baby has an undeveloped or developing blink reflex and may not be able to avoid contact with the eyes. Further, stage 1 baby skin generally has a weaker barrier and may be more susceptible to skin irritation from products, adding to the importance of mildness at the Stage 1 development level. Mildness, as used herein, may include the mild formulations and mildness scores as set forth in U.S. Pat. No. 7,098,180, which is incorporated by reference herein in its entirety. Stage 1 cleansing products may have formulation attributes such as a creamy, cushiony profile, with limited foaming during use. Another formulation attributer for a Stage 1 product includes having a low residue after application, or having a non- or low-slip grip during use, to allow the caregiver to handle the product and care for the baby simultaneously.

For moisturizing products intended for a Stage 1 baby (including, for example, lotions, oils, creams, and the like), the product may be formulated so as to have a formulation attribute that provides a protective layer on the skin of the baby, to prevent excess moisture loss. This may be desired due to the rapid loss of moisture of a Stage 1 baby, particularly as compared to a stage 3 toddler. A formulation attribute of a Stage 1 product may also include a lower level of emollients (particularly as compared to a Stage 3 product), due to the physical needs of the baby's skin.

Stage 1 products may optionally be free of added fragrances, or may include fragrances that are designed so as to have low or no known allergens. Any fragrances included in a Stage 1 product should be intended to respect the baby's developing skin barrier. These fragrances may also be developed to have a specific benefit for the specific developmental stage. In some aspects, there may be a fragrance in the composition that is related to the stage of the child's life. By way of example only, the Stage 1 products may include a fragrance associated with the food consumption at that age. For example, at this stage of life, a baby may only be ingesting breast milk or formula, or simple foods such as apples, pears, and bananas. A fragrance associated with or similar to foods such as milk, apple, pears, bananas, or other simple foods may be added to Stage 1 products, if desired.

The Stage 2 product formulations may be substantially similar to the Stage 1 product formulations, given similarities in the baby and active baby's skin profile, or the products may vary in that the Stage 2 products may provide a higher degree of foaming or bubbling during use than the Stage 1 products. Since a Stage 2 active baby is more able to control its body, for example, by sitting up, the Stage 2 active baby may be able to use a product that has more engaging attributes, such as by providing more foaming during use. In addition, at Stage 2, the active baby is able to start playing during a bath, and the product formulations may include attributes that allow for and encourage play or splashing. Therefore, in some aspects, the stage 2 product may include the same product formulation attribute as a stage 1 product, or may have a different formulation attribute as a stage 1 product.

Stage 2 product formulations may be free of fragrance, or optionally may include fragrances suitable for the age of development of the stage 2 active baby. For example, fragrances may be used that relate to the foods that are introduced to a child at this stage of its life and development. For example, at this stage of life, a Stage 2 active baby is likely to continue drinking milk, but begins to have other foods introduced to it, such as rice, oat, and other simple foods. Fragrances that resemble milk, rice, oat, and simple grains may be used in stage 2 formulations. In addition, during the stage 2 phase of a child's life, it may be introduced to fruits and vegetables. Thus, a stage 2 product may include a fragrance that resembles a single fruit or other fragrant food, such as banana, apple, pear, peach, and other similar fragrant foods. Other stage 2 products may include fragrances that resemble blended foods, since during stage 2, the active baby may begin eating foods that have blends of foods, such as melons and berries, or pineapple and coconut, or apples and cherries, and the like. Combination fragrances may include, by way of example only, caramel and apple, honey and apple, cucumber and melon, or other combination fragrances. Stage 2 products may include simple or light fragrances, which track the foods that the stage 2 active baby is eating.

Stage 3 product formulations may differ from the Stage 1 and Stage 2 formulations by taking into account the various needs of the Stage 3 toddler. The Stage 3 toddler has a more developed skin profile and skin barrier as compared to the Stage 1 or Stage 2 babies, and is able to handle products that may be irritating to the skin of the Stage 1 baby and/or Stage 2 active baby. In addition, the Stage 3 toddler is more able to control its blink reflex, and the mildness scores of a Stage 3 product may be different than that of a Stage 1 or Stage 2 product, if desired. Of course, Stage 3 products should still be considered mild and safe to the eyes and skin, but need not have the identical mildness score or profile as the Stage 1 or Stage 2 products.

Given the cognitive and emotional Stage of a Stage 3 toddler, the product formulations may provide a number of additional attributes that differ greatly from the Stage 1 or Stage 2 products to encourage and account for this growth and development of the toddler's cognitive abilities. By way of example, a Stage 3 cleansing/bath product may include colorants (dyes or pigments), which not only allow for a more fun experience, but also allow the toddler to use a product by himself or herself. The use of colorants in the product allows the toddler to visually inspect the product and understand how much of the product is used and needed during the personal care ritual (such as cleansing the body or hair). Stage 3 bath products may include a higher foaming or bubble profile during use than the Stage 2 bath products, which stimulate the toddler's senses and engage the toddler during the cleansing process. This creates an engaging and fun experience that meets the emotional, social and cognitive needs of the toddler.

Stage 3 skin moisturizing products, such as lotions, creams, and powders, may include a higher level of emollients than the Stage 1 or Stage 2 moisturizing products, since the Stage 3 toddler's skin is more adept and able to handle such components. Stage 3 products may also include a higher level of fragrance or perfume as compared to Stage 1 or Stage 2 products, given the toddler's skin profile. The fragrance in a stage 3 product may be more floral or non-food related, or, in some embodiments, fragrances in stage 3 products may include even more combinations of food-type smells. By the time the child reaches stage 3 of its life, it may be eating even more foods and food blends than a stage 1 and/or a stage 2 child is, and therefore the fragrance(s) added to stage 3 formulations may be more complex and blended. In addition, Stage 3 products may be provided to help attend to or treat skin conditions created by the higher likelihood of a Stage 3 toddler to injure skin due to the Stage 3 toddler being more active than Stage 1 babies or Stage 2 active babies. Due to the nature of activity and play that occurs at this stage of development, toddlers can be more prone to abrasions on the skin or other skin wounds. As skin matures, these cuts and scrapes tend to me more significant than those that could potentially occur on younger skin (e.g., Stage 1 or Stage 2). Stage 3 products may include skin healing products, including antibiotics such as bacitracin, neomycin and polymyxin B.

As can be seen, the product formulations take into account and are directed to not only the physical needs of the human at the appropriate stage (including, for example, foaming profile, skin mildness, eye mildness, colorants, perfumes, skin treatment components, and emollient levels), but these products also take into account the cognitive and emotional state at which the human is in at the given Stage. The use of bubbles, foam, colorants, and product form, for example, are designed with the particular emotional, cognitive and social needs of the human at that stage of life. As babies grow and develop through the different stages, it is also important to consider product application for each specific product format and use. For example, a massage product would be designed to provide the appropriate amount of run in time for a massage. As another example, it may be desired that a sunscreen product for a baby in Stage 1, who may not be mobile at that point in development, can be designed to run in quickly, but might still have a consistency that prevents dripping or running of the product. A sunscreen product designed for a Stage 3, who is more mobile and active than a Stage 1 baby, might require a faster run in time as compared to a stage 1 sunscreen to ensure adequate coverage and protection.

Each product may include all or some of the attributes described above for that particular product. For example, a Stage 3 wash product may include a higher bubble ability (compared to a Stage 2 wash product), but need not necessarily include a colorant or fragrance. Another example is that a stage 1 product may be free of added fragrance, a stage 2 product includes a fragrance associated with one food, such as apple, and a stage 3 product includes a fragrance associated with a more complex fragrance blends. It is desired that the formulations for a given type of product (e.g., a lotion, a wash, a shampoo, etc.) vary among the Stage 1 product, the Stage 2 product, and the Stage 3 product, with the variations accounting for at least one different need of the human at that stage of life.

Thus, for a set of products, the Stage 1 product may differ in at least one formulation attribute from the Stage 2 product, and the Stage 2 product may differ in at least one formulation attribute from the Stage 3 product, and the Stage 3 product may differ in at least one formulation attribute from the Stage 1 product. The formulation attribute differences among the products are desirably based on a specific developmental need of the human at that stage of life.

Indicia

Each product may include an indicator or indicia on its packaging, such as on the label or embedded or secured onto the package. The indicator or indicia used and described herein is a separate feature from the aforementioned packaging attributes. In preferred embodiments a package described herein will include at least one packaging attribute specific to the Stage for which the product is intended, as well as at least one indicator, which is described in more detail below. At least two types of indicators are described herein, use indicators and stage indicators. Use Indicators identify the intended use of the product, for example, whether the product is a wash, a lotion, a cleansing wipe, or any other product described above. Stage Indicators describe the intended Stage of use of the product. Other indicia may be used, for example, to describe the contents of the product, if desired. It is preferable that each product includes at least one Stage Indicator on the package.

To indicate the Stage, a Stage Indicator associated with that stage may be used. Stage Indicators may include pictures, words, designs, numbers, and combinations thereof. In some instances, the Stage Indicator includes an age number, where the age number identifies the Stage of intended use (e.g., 0-6 months, 6-18 months, 18+ months). In other instances, the Stage Indicator includes a Stage number, indicating the stage of intended use (e.g., Stage 1, Stage 2, or Stage 3). In still other instances, the Stage Indicator may include a picture or graphic identifying the Stage of intended use. For example, the Stage Indicator may include a graphic of a newborn for Stage 1, a graphic of an active baby for Stage 2, or a graphic of a toddler for Stage 3. Stage indicators may include actual pictures or photographs of children falling within the Stage range. The Stage Indicator may include combinations of these examples of elements, so long as the Stage Indicator identifies the product with the Stage.

To indicate the intended use of the product, or the type of product that is contained within the package, the package may include a Use Indicator. This Use Indicator may include a word or words describing the use. In other embodiments, this Use Indicator may include a picture or graphic associated with the intended use. For example, for a bath product, such as a wash, the Use Indicator may include a word or phrase indicating that it is a wash, or the Use Indicator may be a water drop, or a symbol of a duck, fish, or other animal associated with water. For a lotion, the Use Indicator may include a word or phrase indicating that it is a lotion, or the Use Indicator may include, by way of example, an oil drop, a symbol of shells, nuts, grains, fruits or vegetables, a symbol of an animal, such as an elephant, rhinoceros, snake or other animal associated with dry skin, a feather, silk, or other animal or character associated with softness. For a hair-care product or detangling product, the Use Indicator may include a word or phrase indicating that it is a hair-care product or detangling product, or the Use Indicator may include a picture of curly or straight hair, or may show another symbol to be associated with hair care.

An Indicator, whether associated with the product, its Use, the Stage, or other indicia, may be the same color or may be a different color than the package, the label, or other design elements. The Use Indicator and the Stage Indicator are used to help a customer or caregiver identify the product and the appropriate Stage of its intended use, and desirably each product described herein includes both a Use Indicator and a Stage Indicator on the package. In some aspects, however, it may be desirable to include only a Use Indicator.

By way of example, the package for a Stage 1 bath wash product may have a product formulation attribute suitable for the Stage 1 baby (for example, the product may be low-foaming and dye-free), and also include label with packaging attributes for the Stage 1 baby (for example, the label on the package may be a light shade of blue, with a plurality of hearts (simple shapes) that are a darker shade of blue), and the label may include a Use Indicator (such as a symbol of a duck), and the label may also include a Stage Indicator (for example, a graphic of a newborn baby). Thus, the product includes a combination of at least one suitable package attribute, one suitable product formulation attribute, one Use Indicator and one Stage Indicator. Other package attributes, formulation attributes, Use Indicators and Stage Indicators may be used as desired.

System or Set of Products

In some embodiments, the invention includes a system of a plurality of products associated with and identifying a particular Stage or Stages. For example, a system (a "formulation system") may include at least one Stage 1 product, at least one Stage 2 product, and at least one Stage 3 product, with each product having at least one Stage-specific packaging attribute and at least one Stage-specific product formulation attribute described above. The products in the system each include at least one Stage Indicator, and optionally may include a Use Indicator. A Formulation System may include a plurality of products that have the same intended use (e.g., a series of lotions or a series of body washes), and therefore the Use Indicators across this formulation system may be identical on each product, even though the Stage Indicators may differ and the product/formulation attributes will differ across Stages. The system may include a plurality of different Stage 1 products, Stage 2 products, and/or Stage 3 products, as described above.

In this embodiment, a Formulation System may include a plurality of products that are similar in intended use (e.g., a set of body washes, a set of lotions, a set of shampoos, etc.), but differ in the intended Stages. That is, a set may include a Stage 1 body wash, a Stage 2 body wash, and a Stage 3 body wash, where each product in the set is designed for its particular Stage and includes at least one packaging attribute and at least one formulation attribute intended for that Stage. To help identify the Stage, each product desirably includes a Stage Identifier. Further, a Use Identifier on each product is desirably used, where the Use Identifier in a Formulation System may be identical.

In a separate embodiment, there may be a "Stage System", which includes a plurality of products that each has a different intended use (for example, a set in a Stage System may include a body wash, a lotion, and a shampoo), however, in this embodiment, each product in the set is designed for one particular Stage. To help identify that Stage, each product desirably includes a Stage Identifier, where each product in the stage system includes the same Stage Identifier. By way of example, a Stage System may include a stage 2 body wash, a stage 2 lotion, and a stage 2 shampoo, where each product in the Stage System includes the same Stage Identifier (e.g., an identified age range, such as 6-18 months). Each product in the Stage System includes at least one package attribute and at least one formulation attribute that is intended for the particular Stage in the system. In this example, each of the stage 2 body wash, a stage 2 lotion, and a stage 2 shampoo includes, respectively, a stage 2 package attribute and a stage 2 formulation attribute.

In yet another embodiment, the set may include a plurality of products that differ in both Stages and in use, where each product includes at least one package attribute and at least one formulation attribute appropriate for the particular Stage of life that it is directed to. In such a set, it may be desired to include both a Stage Indicator and a Use Indicator on each product package, as discussed above.

In some aspects, the products may be provided, sold, or packaged as a set of Stage 1 products, Stage 2 products, or Stage 3 products, and may be provided to a customer or distributor as a set of Stage products. These products may be used directly by the customer or may be displayed and/or sold by a customer or distributor.

Stage Display

In another aspect of the present invention, there is a display apparatus and method of displaying products. In preferred embodiments, the method of displaying products described herein includes arranging a plurality of products according to their particular Stage.

By way of example, there may be a plurality of shelves in the display, where the display may be in a store or may be a virtual store, such as via an online retailer. A first shelf may include a plurality of Stage 1 products, a second shelf may include a plurality of Stage 2 products, and a third shelf may include a plurality of Stage 3 products. Each shelf may be placed at approximately the eye level of a human, or the products may be placed at different height levels. For example, Stage 1 products may be placed on a first shelf at the eye level of a caregiver who is walking through a store. In some aspects, the first shelf may be the highest shelf of the three shelves. Stage 2 products may be placed on a shelf directly below the Stage 1 shelf, which may be approximately the eye level of an active baby sitting in a shopping cart. Stage 3 products may be placed on a shelf that is directly below the Stage 3 product shelf, which may be at approximately the eye level of a toddler walking in the store.

Each shelf display may include a product set, the product set including a plurality of products intended for the same Stage, where the products include at least two of the products described above. It is desirable that each product on the shelf include a common Stage Indicator for which the products are intended for use. It may also be desired that each product includes a Use Indicator identifying the intended use of the product. Since different products may be arranged adjacent to other products with a different use, it may be helpful to include the Use Indicator to help identify the use of each product.

The shelf may optionally include a separate Stage Display on or near the particular shelf. A Stage Display may include a graphic or other visual aid, which identifies the Stage for which the products are intended for use. The Stage Display may include the same Stage Indicator that is used on the product set for which it is associated. For example, one shelf may include a product set of Stage 1 products, including a hair conditioner, a lotion, and a powder product, where each Stage 1 product includes a common Stage Indicator (e.g., a graphic of a baby, or a number indicating the Stage). The shelf may additionally include a Stage Display, which is a placard or other visual element that includes the same Stage Indicator that is used on each of the Stage 1 products that are placed on that shelf.

In some embodiments, the display may include three separate shelves, wherein each shelf includes a plurality of products that are for the same Stage, where each product on the same shelf has the same Stage Indicator, and each shelf includes a Stage Display with the same Stage Indicator. Each product may additionally include Use Indictor on its label. In this display, the first shelf may be for Stage 1 products, the second shelf may be for Stage 2 products, and the third shelf may be for Stage 3 products.

Alternatively, the display may include one shelf with at least two sets of products on the shelf, each set of products being for a particular Stage, and including a common Stage Indicator on the package. The shelf may include a Stage Display to identify the Stage adjacent to, above, or below the set of products to which it identifies.

In some aspects, the shelf display may be related to a virtual display, such as that which would be used in a computerized manner, such as via a website or through e-commerce. The graphical display on the computer system could display a series of shelves having the above attributes with Stage Displays for each grouping of products on the virtual shelf.

Kits

The invention may include a kit, where a kit includes a plurality of products related to one particular Stage. It is desired that the products in the kit each include a common style of Stage Indicator on the package, to identify the Stage. A kit may include, for example, a Stage System, with a plurality of products intended for the same Stage of life, where the products vary in intended use. A kit may include, for example, a Formulation System, with a plurality of products intended for the same Use, but varying among the intended stage of life.

The kit may be packaged in a container with a label or other feature identifying the stage or intended use of products contained within the container. In instances where the kit includes a Stage System, the identifying feature on the container may be the same Stage Indicator that appears on the plurality of products contained therein. In instances where the kit includes a Formulation System, the identifying feature on the container may be the same Use Indicator that appears on the plurality of products contained therein.

The kit may optionally include a set of instructions, where the instructions explain the intended use of each product contained within the kit. The instructions may optionally include the same Stage Indicator or Use Indicator that is used on each of the product packages within the kit.

A kit may further include a secondary device that is appropriate for the stage intended, for example, a toy, book, or other learning device that is suitable for the intended stage.

Methods of Use

The present invention may also include various methods of use of the aforementioned systems or products. By way of example, a method may include a caregiver selecting a Stage 1 product appropriate for a Stage 1 baby and using that Stage 1 product on the baby. The method may also or alternatively include a caregiver selecting a Stage 2 product appropriate for a Stage 2 active baby, and either using that Stage 2 product on the Stage 2 active baby, or the caregiver and the Stage 2 active baby using the Stage 2 product together or collaboratively. In certain methods, the packaging and product in a Stage 2 product may allow for collaborative use with the caregiver and the Stage 2 active baby. In methods described herein, a caregiver may select a Stage 3 product appropriate for a Stage 3 toddler, and provide the Stage 3 product to the toddler for the Stage 3 toddler to dispense and/or use independently of the caregiver. The packaging and products in a Stage 3 product may allow for a Stage 3 toddler to use independently or with less help from caregiver.

EXAMPLES

The following are several exemplary embodiments of the invention, but these Examples are only demonstrative and are not intended to be limiting to the particular combinations described below.

A first Example is a system of products may include a set of body washes (i.e., a Formulation System), which includes a first body wash, a second body wash, and a third body wash. The first body wash includes a Stage Indicator, which is an age range, such as 0 to 6 months. The first body wash includes a Use Indicator, which is a graphic of bubbles. The first body wash includes a package that is a simple color and includes a plurality of circles. The first body wash is mild, low foaming, with no dyes or colorants. The second body wash includes a Stage Indicator that shows an age range from 6 months to 18 months. The second body wash includes the same Use Indicator as the first body wash, which is a graphic of bubbles. The second body wash is slightly more foaming than the first body wash. The third body wash includes a Stage Indicator that shows an age range above 18 months, and also includes the same Use Indicator, which is a graphic of bubbles. The third body wash is higher foaming than the second body wash, and includes a colorant. The third body wash may include a pump dispenser to allow a toddler to dispense the product himself or herself.

A second Example is a system of products including a set of lotions, where the package attributes are the same as in the first Example; however, the Use Indicator on each package shows an oil droplet. Thus, in this Example, the first lotion includes a Stage Indicator, which is an age range, such as 0 to 6 months. The first lotion includes a Use Indicator, which is a graphic of an oil droplet. The first lotion includes a package that is a simple color and includes a plurality of circles. The first lotion is mild, with no dyes and no added fragrances. The second lotion includes a Stage Indicator that shows an age range from 6 months to 18 months. The second lotion includes the same Use Indicator as the first body wash, which is a graphic of an oil droplet. The third lotion includes a Stage Indicator that shows an age range above 18 months, and also includes the same Use Indicator, which is a graphic of an oil droplet. The third lotion includes a colorant.

A third Example is a system of products including body washes, identical to the system of the first Example, but the Stage Indicator shows graphical depictions of a child. The first body wash shows a Stage Indicator with a cartoon picture of a newborn baby. The second body wash shows a Stage Indicator with a cartoon picture of a child with a small amount of hair, or a cartoon picture of a crawling baby. The third body wash shows a Stage Indicator with a cartoon picture of a child with more hair than the picture on the second body wash, or a picture of a child walking.

A fourth Example is a system of products including lotions, identical to the system of the second Example, but the Stage Indicator shows graphical depictions of a child. The first lotion shows a Stage Indicator with a cartoon picture of a newborn baby. The second lotion shows a Stage Indicator with a cartoon picture of a child with a small amount of hair, or a cartoon picture of a crawling baby. The third lotion shows a Stage Indicator with a cartoon picture of a child with more hair than the picture on the second lotion, or a picture of a child walking.

A fifth Example is a system of products including lotions, identical to the system of the second Example, but the Use Indicator of each product shows cartoon picture of an elephant.

A sixth Example is a system of products spanning different product types intended for the same stage of life (a Stage System, as defined above). In this Example, there includes a lotion, a body wash, and a shampoo, each intended for a stage 1 baby. The body wash includes a Stage Indicator, which is a label identifying an age range, such as 0 to 6 months. The body wash in this Example also includes a Use Indicator, which is a graphic of bubbles. The body wash includes a package that is a simple color and includes a plurality of circles. The body wash is mild, low foaming, with no dyes and no added fragrances. The lotion includes the same Stage Indicator as the body wash, which is a label identifying the age range of 0 to 6 months. The lotion includes a Use Indicator, which is a graphic of an oil droplet. The lotion includes a package that is a simple color and includes a plurality of circles. The lotion is mild, with no dyes and no added fragrances. The shampoo also includes the same Stage Indicator as the body wash and the lotion, which is a label identifying the age range of 0 to 6 months. The shampoo includes a Use Indicator, which is a graphic of straight or curly hair. The shampoo includes a package that is a simple color and includes a plurality of circles. The shampoo is mild, low foaming, with no dyes and no added fragrances. Thus, each of the products in the sixth Example includes the same Stage Indicator, since each product is intended for the same stage of life.

A seventh Example uses the same products as the sixth Example, however, the Stage Indicator is a graphic or cartoon picture of a newborn baby.

An eighth Example provides a system of products spanning different product types intended for the same stage of life (a Stage System, as defined above). In this Example, there includes a lotion, a body wash, and a shampoo, each intended for a stage 3 toddler. The body wash includes a Stage Indicator, which is a label identifying an age range, such as 18+ months. The body wash in this Example also includes a Use Indicator, which is a graphic of bubbles. The body wash includes a package that is a bright color and includes complicated shapes or shows a cartoon scene with a hidden object within the scene, such as a heart. The body wash provides a high degree of foaming/bubble formation, and includes a colorant. The lotion includes the same Stage Indicator as the body wash, which is a label identifying the age range of 18+ months. The lotion includes a Use Indicator, which is a graphic of an oil droplet. The lotion includes a package that is a bright color and includes complicated shapes or shows a cartoon scene with a hidden object within the scene, such as a heart. The lotion may include additional components not suitable for stage 1 or stage 2 babies, and may include an added fragrance. The shampoo also includes the same Stage Indicator as the body wash and the lotion, which is a label identifying the age range of 18+ months. The shampoo includes a Use Indicator, which is a graphic of straight or curly hair. The shampoo includes a package that is a bright color and includes complicated shapes or shows a cartoon scene with a hidden object within the scene, such as a heart. The shampoo provides a high degree of foaming/bubble formation, and may include a colorant. Thus, each of the products in the eighth Example includes the same Stage Indicator, since each product is intended for the same stage of life.

A ninth Example uses the same products as the eighth Example, however, the Stage Indicator is a graphic or cartoon picture of a newborn baby.

Different combinations of formulation attributes, package attributes, Stage Indicators, and Use Indicators may be used for various products, including, as described above, a wash, lotion, shampoo, bubble bath, cream, oil, butter, solid oil, powder, bar, wipe, cologne, conditioner, cleansing water, liquid powder, oil to powder, ointment, or gel. For each system including a series of products for use across different stage ranges, the Use Indicator of each product may remain the same, while the Stage Indicator may change to reflect the appropriate Stage intended for each product. For each system including a series of products for use across different uses, but the same stage, the Stage Indicator of each product may remain the same, while a Use Indicator (if used) may change to reflect the intended use of each product. The formulation attributes and package attributes for each product reflects the appropriate formulation attribute and package attribute for that particular Stage.

What is claimed is:

1. A system of personal care products comprising:

a. a first personal care product for stage 1 of a human life, wherein stage 1 of a human life is generally from birth to about six months of life, the first personal care product including a first package that includes a simple color and one simple shape, the first personal care product having a high mildness score, being free of dye, and having a first formulation attribute designed for the human at stage 1 of life, wherein at least one first formulation attribute is fragrance, and wherein the fragrance is a fragrance associated with simple foods;

b. a second personal care product for stage 2 of a human life, wherein stage 2 of a human life is generally from about six months of life to about 18 months of life, the second personal care product including a second package that includes at least one more color than the first personal care product, and the second package having at least two different simple shapes, the second personal care product having a second formulation attribute designed for the human at stage 2 of life wherein the second formulation attribute is different than the first formulation attribute, wherein at least one second formulation attribute is fragrance, and wherein the fragrance is selected from the group consisting of a fragrance that resembles a single fruit or other fragrant food or a fragrance that resembles a simple blend of food;

c. a third personal care product for stage 3 of a human life, wherein stage 3 of human life is generally from about 18 months of life to about 3 years of life, the third personal care product including a third package that includes more colors than the second personal care product, the third package including complex shapes, the third personal care product having a third formulation attribute designed for the human at stage 3 of life wherein the third formulation attribute is different than the second formulation attribute, wherein at least one third formulation attribute is fragrance, and wherein the fragrance is a fragrance associated with the group consisting of floral, non-food related and complex blends of foods, wherein the personal care products are selected from group consisting of wash, lotion, shampoo, bubble bath, cream, oil, butter, solid oil, powder, bar, wipe, cologne, conditioner, cleansing water, liquid powder, oil to powder, ointment, and gel;

wherein each stage defines a period of time in which a human has reached or is in the process of reaching at least two developmental milestones selected from cognitive developmental milestone, emotional developmental milestone, social developmental milestone and/or physical developmental milestone.

2. The system of claim 1, wherein the first, second and third personal care products are each independently cleansers.

3. The system of claim 1, wherein the first personal care product package comprises a pastel color.

4. The system of claim 1, wherein the first personal care product package consists of words and one simple shape graphical element, wherein the simple shape is selected from group consisting of square, circle, triangle, and heart.

5. The system of claim 1, wherein the second personal care product package comprises two contrasting colors.

6. The system of claim 1, wherein the second personal care product package comprises a first simple shape and a second simple shape, each of said first simple shape and second simple shape independently selected from group consisting of square, circle, triangle, and heart.

7. The system of claim 1, wherein the third personal care product package has at least one complex graphical element.

8. The system of claim 1, wherein the first, second and third personal care product packages have a common indicia identifying the intended use of the personal care products.

9. The system of claim 1, wherein the first, second and third personal care product packages each independently include an indicator identifying the stage of life for use of each respective personal care product.

10. The system of claim 1, wherein the system includes at least two personal care products for stage 2 of a human life, wherein the at least two personal care products for stage 2 of a human life are different personal care products from each other, and wherein the at least two personal care products for stage 2 of a human life are independently selected from group consisting of wash, lotion, shampoo, bubble bath, cream, oil, butter, solid oil, powder, bar, wipe, cologne, conditioner, cleansing water, liquid powder, oil to powder, ointment, and gel.

11. The system of claim 1, wherein the system includes at least two personal care products for stage 3 of a human life, wherein the at least two personal care products for stage 3 of a human life are different personal care products from each other, and wherein the at least two personal care products for stage 3 of a human life are independently selected from group consisting of wash, lotion, shampoo, bubble bath, cream, oil, butter, solid oil, powder, bar, wipe, cologne, conditioner, cleansing water, liquid powder, oil to powder, ointment, and gel.

12. The system of claim 10, wherein the at least two personal care products for stage 1 of a human life are packaged in a kit.

13. The system of claim 11, wherein the at least two personal care products for stage 1 of a human life are packaged in a kit.

14. The system of claim 1, wherein the formulation attribute is selected from the group consisting of a foaming profile, bubble forming ability during use, the thickness of the product, the cushion profile of the product when dispensed, the rinsability of the product during use, the formation of a residue after application, the texture of the product and whether it provides a non-slip grip or low-slip grip during use, the ability of the product to form a barrier on the skin of the human after use, the imparting of softness on the skin of the human during and after the use, and providing a cooling or warming sensation on the skin.

15. A method of displaying the personal care products of claim 1, comprising positioning the first, second, third personal care products on a display shelf in distinct positions whereby each of the first, second and third personal care products are physically separated from each other.

16. A system of personal care products for a selected stage of life comprising:

a. a first personal care product for stage 1 of a human life, the first personal care product including a first package that includes a simple color and one simple shape, the first personal care product including a stage indicator identifying stage 1 of life, the first personal care product having a formulation attribute designed for the human at stage 1 of life, wherein at least one first formulation attribute is fragrance, and wherein the fragrance is a fragrance associated with simple foods;

b. a second personal care product for stage 1 of a human life, the second personal care product including a second package that includes a simple color and one simple shape, the second personal care product including a stage indicator identifying stage 1 of life, the second personal care product having a formulation attribute designed for the human at stage 1 of life, wherein at least one second formulation attribute is fragrance, and wherein the fragrance is selected from the group consisting of a fragrance that resembles a single fruit or other fragrant food or a fragrance that resembles a simple blend of food; and c. a third personal care product for stage 1 of a human life, the third personal care product including a third package that includes a simple color and one simple shape, the third personal care product including a stage indicator identifying stage 1 of life, the third personal care product having a formulation attribute designed for the human at stage 1 of life, wherein at least one third formulation attribute is fragrance, and wherein the fragrance is a fragrance associated with the group consisting of floral, non-food related and complex blends of foods;

d. wherein the stage indicator identifying stage 1 of life is the same for the first personal care product, the second personal care product, and the third personal care product, wherein the personal care products are selected from group consisting of wash, lotion, shampoo, bubble bath, cream, oil, butter, solid oil, powder, bar, wipe, cologne, conditioner, cleansing water, liquid powder, oil to powder, ointment, and gel;

wherein each stage defines a period of time in which a human has reached or is in the process of reaching at least two developmental milestones selected from cognitive developmental milestone, emotional developmental milestone, social developmental milestone and/or physical developmental milestone, wherein the stage indicator is a numerical representation of the ages of stage 1 of human life.

17. The system of personal care products of claim 16, wherein the first, second and third personal care products each include a Use Indicator identifying the intended use of the product.

* * * * *